US008821191B2

(12) United States Patent
Soo

(10) Patent No.: US 8,821,191 B2
(45) Date of Patent: Sep. 2, 2014

(54) ELECTRICAL CONNECTOR ASSEMBLY

(71) Applicant: Molex Incorporated, Lisle (IL)

(72) Inventor: Foong-Ching Soo, Singapore (SG)

(73) Assignee: Molex Incorporated, Lisle, IL (US)

( * ) Notice: Subject to any disclaimer, the term of this patent is extended or adjusted under 35 U.S.C. 154(b) by 70 days.

(21) Appl. No.: 13/720,287

(22) Filed: Dec. 19, 2012

(65) Prior Publication Data

US 2013/0157481 A1 Jun. 20, 2013

(30) Foreign Application Priority Data

Dec. 19, 2011 (SG) ..... 201109434-9

(51) Int. Cl.
*H01R 24/00* (2011.01)

(52) U.S. Cl.
USPC ..... 439/630

(58) Field of Classification Search
USPC ..... 439/630, 862, 159
See application file for complete search history.

(56) References Cited

U.S. PATENT DOCUMENTS

| | | | | |
|---|---|---|---|---|
| 7,056,193 | B2 * | 6/2006 | Yoshikawa et al. | 451/36 |
| 7,390,205 | B2 | 6/2008 | Wang et al. | |
| 7,435,117 | B2 * | 10/2008 | Ma | 439/188 |
| 7,510,443 | B2 * | 3/2009 | Ma | 439/630 |
| 7,635,276 | B1 * | 12/2009 | Chu et al. | 439/326 |
| 7,645,166 | B1 * | 1/2010 | Wang | 439/630 |
| 7,775,826 | B1 * | 8/2010 | Wang | 439/489 |
| 7,955,135 | B2 * | 6/2011 | Wang et al. | 439/630 |
| 8,079,876 | B2 * | 12/2011 | Wang et al. | 439/630 |
| 8,597,057 | B2 * | 12/2013 | Yu et al. | 439/630 |
| 2005/0130499 | A1 * | 6/2005 | Zheng et al. | 439/630 |
| 2007/0134989 | A1 * | 6/2007 | Yang et al. | 439/630 |

FOREIGN PATENT DOCUMENTS

| | | |
|---|---|---|
| TW | M499058 U | 8/2002 |
| TW | 532628 | 5/2003 |
| TW | M321606 | 11/2007 |
| TW | M337163 | 7/2008 |

* cited by examiner

*Primary Examiner* — Gary Paumen

(74) *Attorney, Agent, or Firm* — Stephen L. Sheldon

(57) ABSTRACT

A connector includes a housing and at least one terminal. The at least one terminal comprises a base portion, two attaching portions and an elastic arm portion. The two attaching portions are configured to have a height different from that of the base portion and are attached to the housing. The two attaching portions of each terminal can be disposed adjacent to the corresponding end portion of the housing and respectively on opposite sides of the corresponding opening.

21 Claims, 17 Drawing Sheets

ELECTRICAL CONNECTOR ASSEMBLY

RELATED APPLICATIONS

This application claims priority to Singapore Application No. 201109434-9, filed Dec. 19, 2011, which is incorporated herein by reference in its entirety.

FIELD OF THE INVENTION

The present invention relates to an electrical connector assembly.

DESCRIPTION OF THE RELATED ART

A SIM (subscriber identity module or subscriber identification module) connector is designed for connecting a SIM card. FIGS. 1 and 2 illustrate terminals 91 and an insulative housing 92 included in a conventional SIM connector 9 mountable on a circuit board 93, disclosed in Taiwan Patent No. 499058. As shown in FIGS. 1 and 2, the terminals 91 are arranged in an array and integrated with the insulative housing 92. Each terminal 91 has a contact part 911 disposed above the insulative housing 92 for contacting the contact pads on an inserted SIM card and a soldering part 912 solderable on a corresponding pad 931 formed on the circuit board 93.

Usually, as shown in FIG. 1, the soldering parts 912 are tiny and may be easily deformed or moved away from their predetermined positions during manufacturing operations. When the terminals 91 are integrated with the insulative housing 92, the soldering parts 912 might not be on the same plane. Consequently, the soldering part 912 of the terminal 91 that is not on the same plane as most terminals 91 may result in false solder joint defects or poor electrical connections.

In addition, the SIM connector 9 is designed for compact electronic devices. The insulative housing 92 is thin and equipped with two supporting portions 921 respectively formed on the two opposite sides of the insulative housing 92. A through-hole 94 is formed on the circuit board 93 with a size suitable to partially receive the insulative housing 92. When the SIM connector 9 is installed, a portion of the insulative housing 92 enters the through-hole 94, and the two supporting portions 921 rest on the circuit board 93, providing main support for the SIM connector 9. As such, the height of the insulative housing 92 above the circuit board 93 can be minimized.

When a SIM card engages the SIM connector 9, the SIM card depresses the contact parts 911 of the terminals 91, and the two supporting portions 921 are stressed, providing most of the supporting force. As new electronic device designs become thinner, the thickness of the insulative housing 92 must be further reduced. Accordingly, the height of the insulative housing 92 above the circuit board 93 is further reduced. Because the insulative housing 92 is thin and merely supported on two opposite sides, the insulative housing 92 may be easily bent downward and curved in a bow shape. Moreover, the thinner supporting portions 921 become weak and can easily be broken when a SIM card is inserted.

SUMMARY OF THE INVENTION

One embodiment includes an electrical connector assembly comprising a circuit board and an electrical connector comprising a housing and terminals each including a base portion solderable to the circuit board. The housing and the terminals are configured such that after the housing and the terminals are combined, the base portions of the terminals can be on the same plane. In an embodiment, the base portions of the terminals can provide sufficient support to the electrical connector after the electrical connector is placed on the circuit board. In an embodiment, the terminals can be configured so that when the contact parts of the terminals are depressed, the depressing force is transmitted to the circuit board through the base portions.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
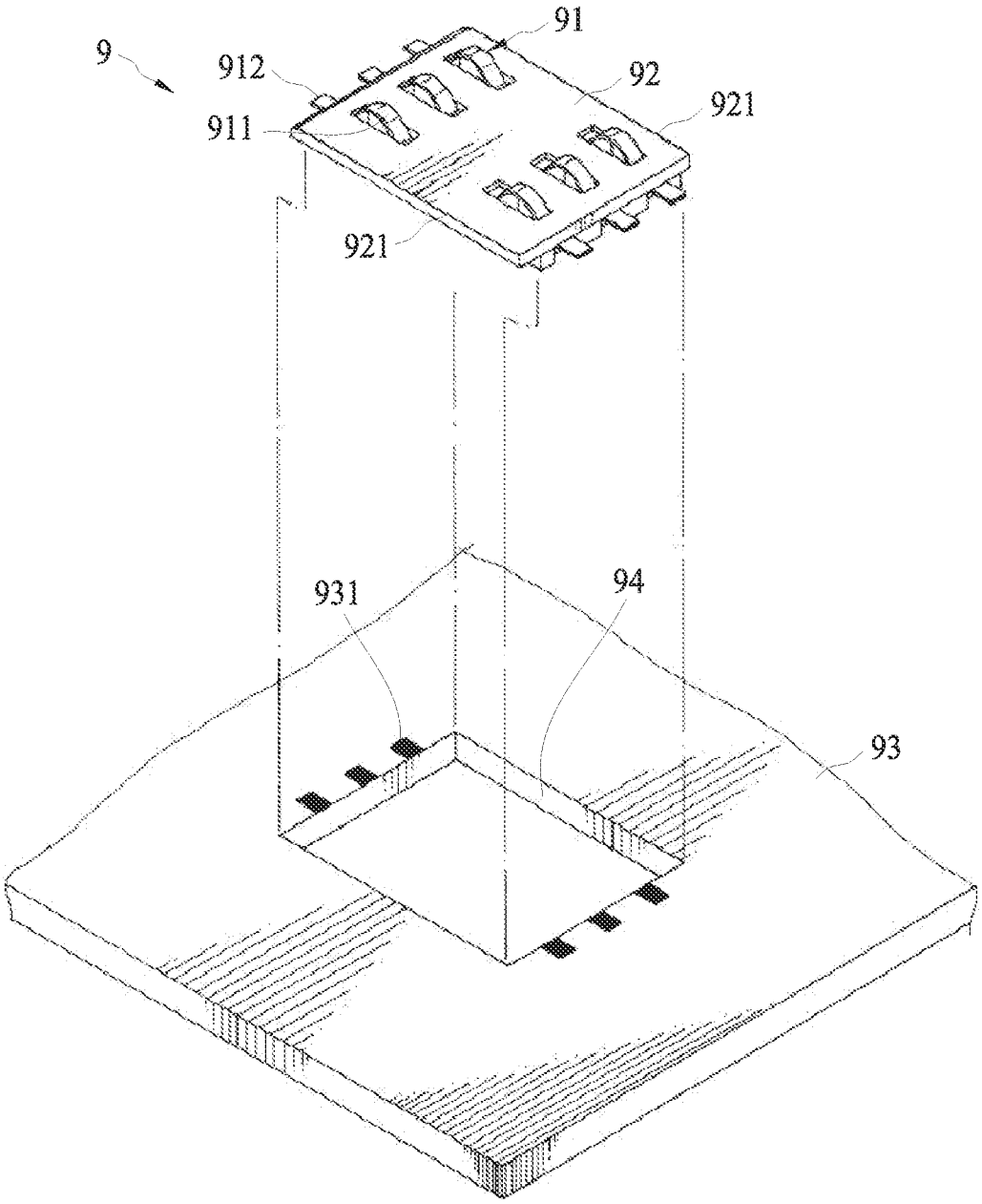
FIG. 1 (Prior Art)
FIG. 1 illustrates terminals and an insulative housing included in a conventional SIM connector mountable on a circuit board and disclosed in Taiwan Patent No. 499058.
Figure 2:
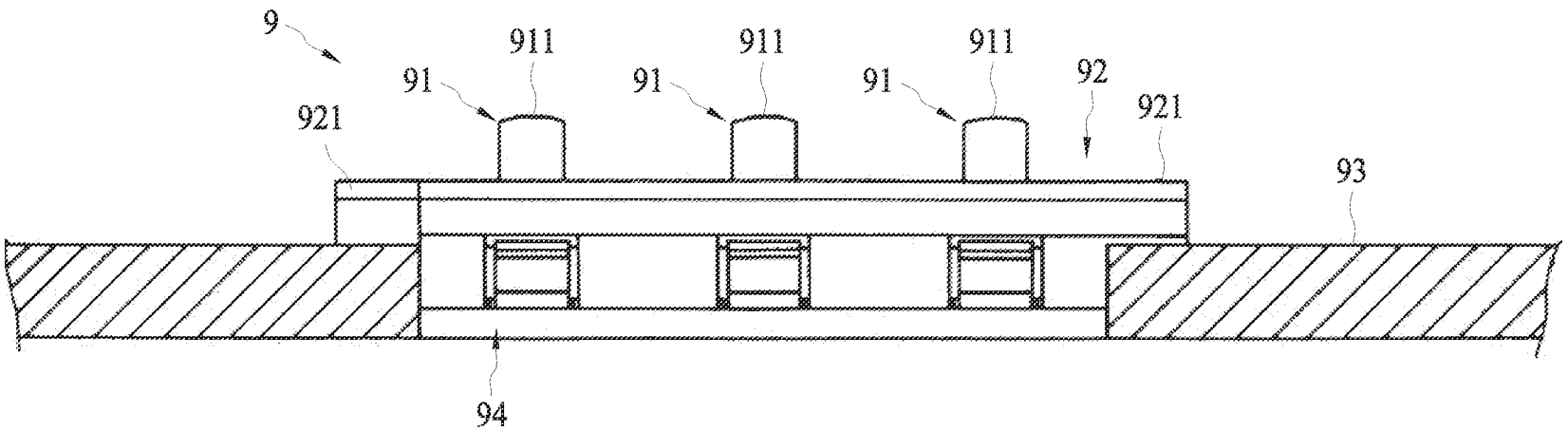
FIG. 2 (Prior Art)
FIG. 2 illustrates another view of the connector depicted in FIG. 1.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

In one embodiment, an electrical connector assembly comprises an electrical connector that comprises a housing and a plurality of terminals. The housing can be configured as a plate-like body. The housing may comprise a bottom surface, an upper surface opposite the bottom surface, opposite end portions, opposite side portions, and a plurality of openings, wherein the plurality of openings can be formed from the upper surface to the bottom surface and adjacent to the opposite end portions. The plurality of terminals correspond to the plurality of openings. Each terminal comprises a base portion, two attaching portions, two connecting portions, and an elastic arm portion. The base portion may include a soldering portion and opposite first and second edges. In each terminal, the two attaching portions may extend parallel to a direction from the second edge to the first edge and be configured to have a height different from that of the base portion, and the two connecting portions can be respectively disposed adjacent to the opposite ends of the first edge and correspondingly connect the first edge and the attaching portions. In each terminal, the elastic arm portion may include a contact part and extend, from a location between the opposite ends of the first edge, upward and along the direction from the second edge to the first edge with the contact part above the corresponding opening. The two attaching portions of each terminal can be attached to the housing. The two attaching portions of each terminal may be disposed adjacent to the corresponding end portion of the housing and respectively on opposite sides of the corresponding opening. The base portion and the connecting portions of each terminal may be disposed outside the corresponding end portion.

In another embodiment, an electrical connector assembly comprising a circuit board and an electrical connector is disclosed. The electrical connector can be mountable on the circuit board, which includes a through-hole and a plurality of soldering portions, wherein the plurality of soldering portions are disposed adjacent to opposite sides of the through-hole. The electrical connector may comprise two insulating bodies and a plurality of terminals. The two insulating bodies can be configured as plate-like bodies. Each housing may comprise a bottom surface, an upper surface opposite the bottom surface, an end portion, opposite side portions, a plurality of openings, and two protrusions, wherein the plurality of openings may be formed from the upper surface to the bottom surface and be adjacent to the end portion, and two protrusions may be disposed respectively on the side portions. The plurality of terminals correspond to the openings of the two insulating bodies. Each terminal may comprise a base portion, two attaching portions, two connecting portions, and an elastic arm portion. The base portion may include a soldering portion and opposite first and second edges. In each terminal, the two attaching portions may extend parallel to a direction from the second edge to the first edge and be configured to have a height different from that of the base portion, and the two connecting portions may be respectively disposed adjacent to opposite ends of the first edge and correspondingly connect the first edge and the attaching portions. In each terminal, the elastic arm portion may include a contact part, and may extend, from a location between the ends of the first edge, upward and along the direction from the second edge to the first edge with the contact part above the corresponding opening. The two attaching portions of each terminal can be attached to the corresponding housing. The two attaching portions of each terminal can be disposed adjacent to the corresponding end portion and respectively on opposite sides of the corresponding opening. The base portion and the connecting portions of each terminal are disposed outside the corresponding end portion. The attaching portions of each terminal are lower than the corresponding base portion, the soldering portions of the circuit board are on the upper surface and the protrusions of each housing are against the upper surface of the circuit board when the electrical connector is mounted on the circuit board, or alternatively the attaching portions of each terminal are higher than the corresponding base portion, the soldering portions of the circuit board are on the bottom surface and the protrusions of each housing are against the bottom surface of the circuit board when the electrical connector is mounted on the circuit board. When the electrical connector is mounted on the circuit board, a portion of each housing is in the through-hole, the connecting portions of each terminal are adjacent to and separated from a corresponding side wall defining the through-hole, and the soldering portions of the terminals are solderable to the corresponding soldering portions of the circuit board.

In another embodiment, an electrical connector assembly comprising a circuit board and an electrical connector is disclosed. The electrical connector is mountable on the circuit board, which includes two through-holes and a plurality of soldering portions disposed adjacent to farthest opposite sides of the through-holes. The electrical connector may comprise two insulating bodies and a plurality of terminals. The two insulating bodies may be configured as plate-like bodies. Each housing may comprise a bottom surface, an upper surface opposite the bottom surface, opposite end portions, opposite side portions, a plurality of openings, and two protrusions, wherein the plurality of openings can be formed from the upper surface to the bottom surface, and the two protrusions can be disposed respectively on the side portions and adjacent to the upper surface. The plurality of terminals correspond to the openings of the two insulating bodies. Each terminal comprises a base portion, two attaching portions, two connecting portions and an elastic arm portion. The base portion may include a soldering portion solderable to one of the soldering portion of the circuit board and opposite first and second edges. The two attaching portions of each terminal may extend parallel to a direction from the corresponding second edge to the corresponding first edge. The two connecting portions of each terminal may be respectively disposed adjacent to opposite ends of the corresponding first edge and correspondingly connect the first edge and the corresponding attaching portions. The elastic arm portion may include a contact part, and may extend, from a location between the ends of the corresponding first edge, upward and along the direction from the corresponding second edge to the corresponding first edge with the contact part above the corresponding opening. The two attaching portions of each terminal are configured to be lower than the corresponding base portion and the two protrusions are adjacent to the upper surface of the housing and against an upper surface of the circuit board when the electrical connector is mounted on the circuit board, or the two attaching portions of each terminal are configured to be higher than the corresponding base portion and two protrusions are adjacent to the bottom surface of the housing and against a bottom surface of the circuit board when the electrical connector is mounted on the circuit board. The connecting portions of each terminal may be adjacent to a corresponding side wall defining the through-hole. The connecting portions of each terminal may be separated from the corresponding side wall defining the through-hole and adjacent to the corresponding soldering portions of the circuit board.

In another embodiment, an electrical connector assembly comprises an electrical connector. The electrical connector comprises a housing and a terminal. The housing is configured as a plate-like body. The housing comprises a bottom surface, an upper surface opposite the bottom surface, an end portion, opposite side portions, and an opening. The opening is formed from the upper surface to the bottom surface and adjacent to the end portion. The terminal comprises a base portion including a soldering portion and opposite first and second edges, two attaching portions extending parallel to a direction from the second edge to the first edge and configured to have a height different from that of the base portion, two connecting portions respectively disposed adjacent to opposite ends of the first edge and correspondingly connecting the first edge and the attaching portions, and an elastic arm portion including a contact part and extending from a location between the ends of the first edge. The elastic arm portion extends upward and along the direction from the second edge to the first edge with the contact part above the opening. The two attaching portions of the terminal are attached to the housing. The two attaching portions of the terminal are disposed adjacent to the end portion of the housing and respectively on opposite sides of the opening. The base portion and the connecting portions of the terminal are disposed outside the end portion of the housing.

Figure 3:
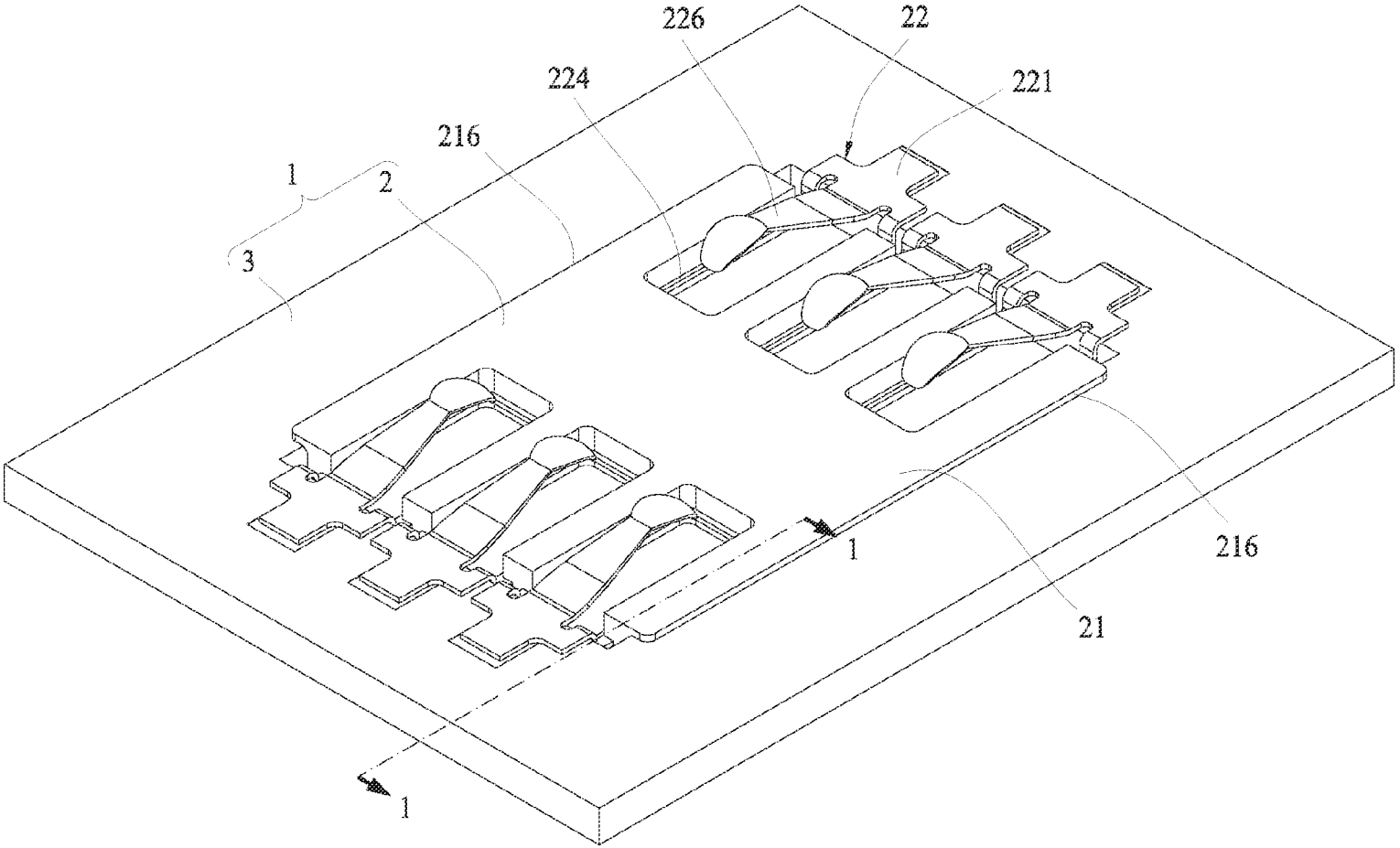
FIG. 3 is a perspective view showing an electrical connector assembly according to one embodiment.
Figure 4:
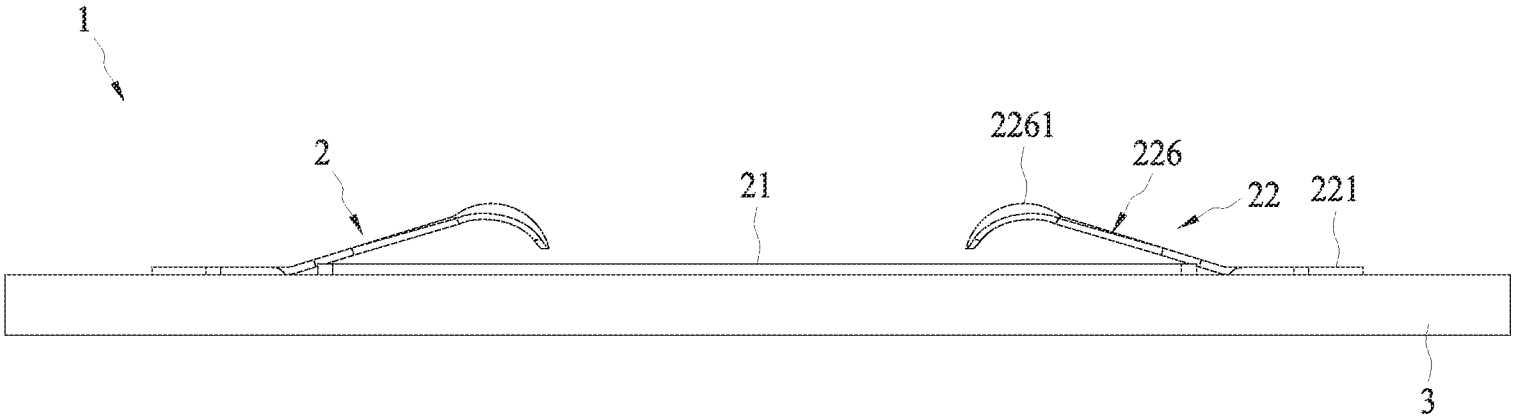
FIG. 4 shows a side view of the electrical connector assembly of FIG. 3.
Figure 5:
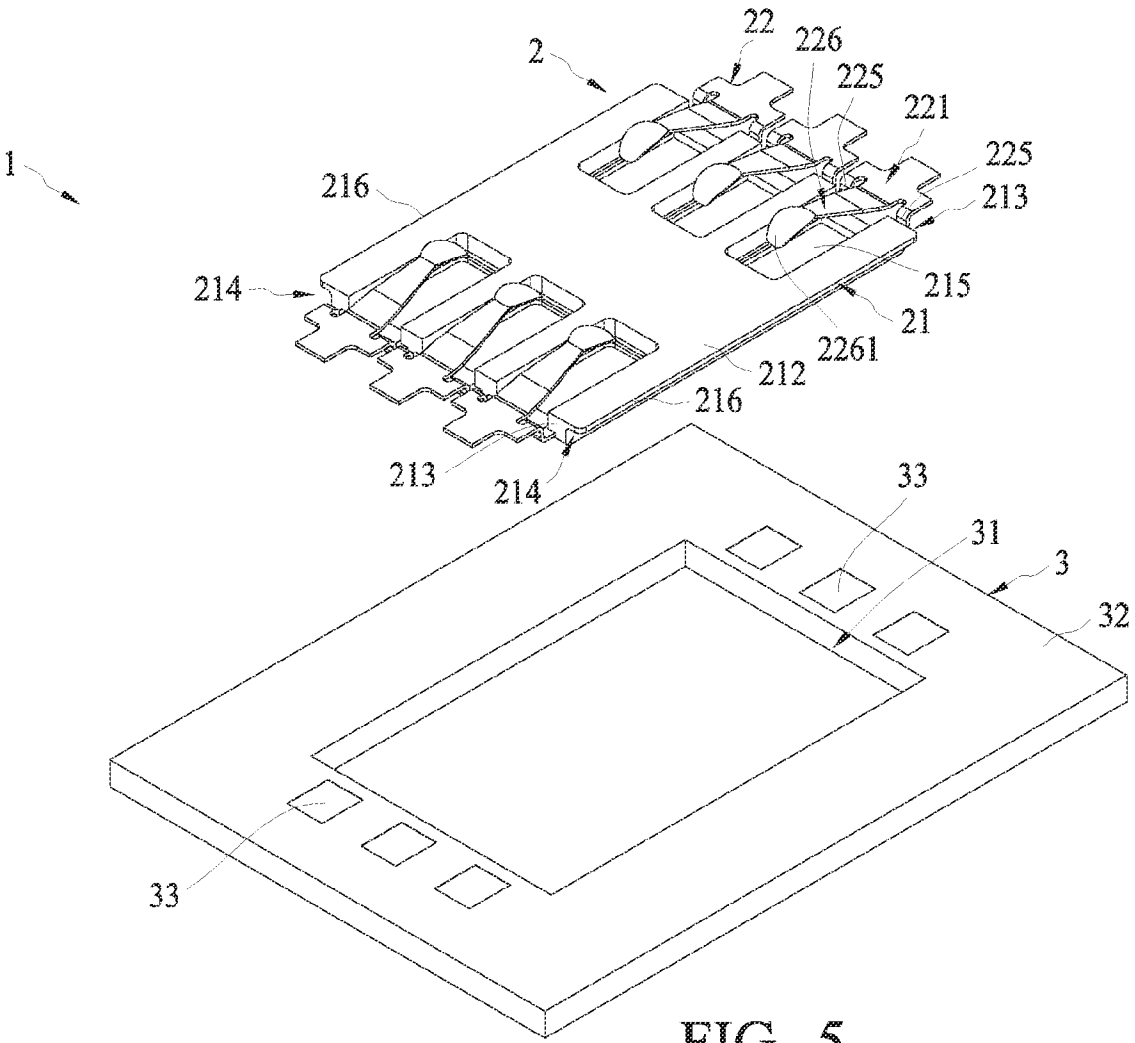
FIG. 5 is a perspective exploded view of the electrical connector assembly of FIG. 3.
Figure 6:
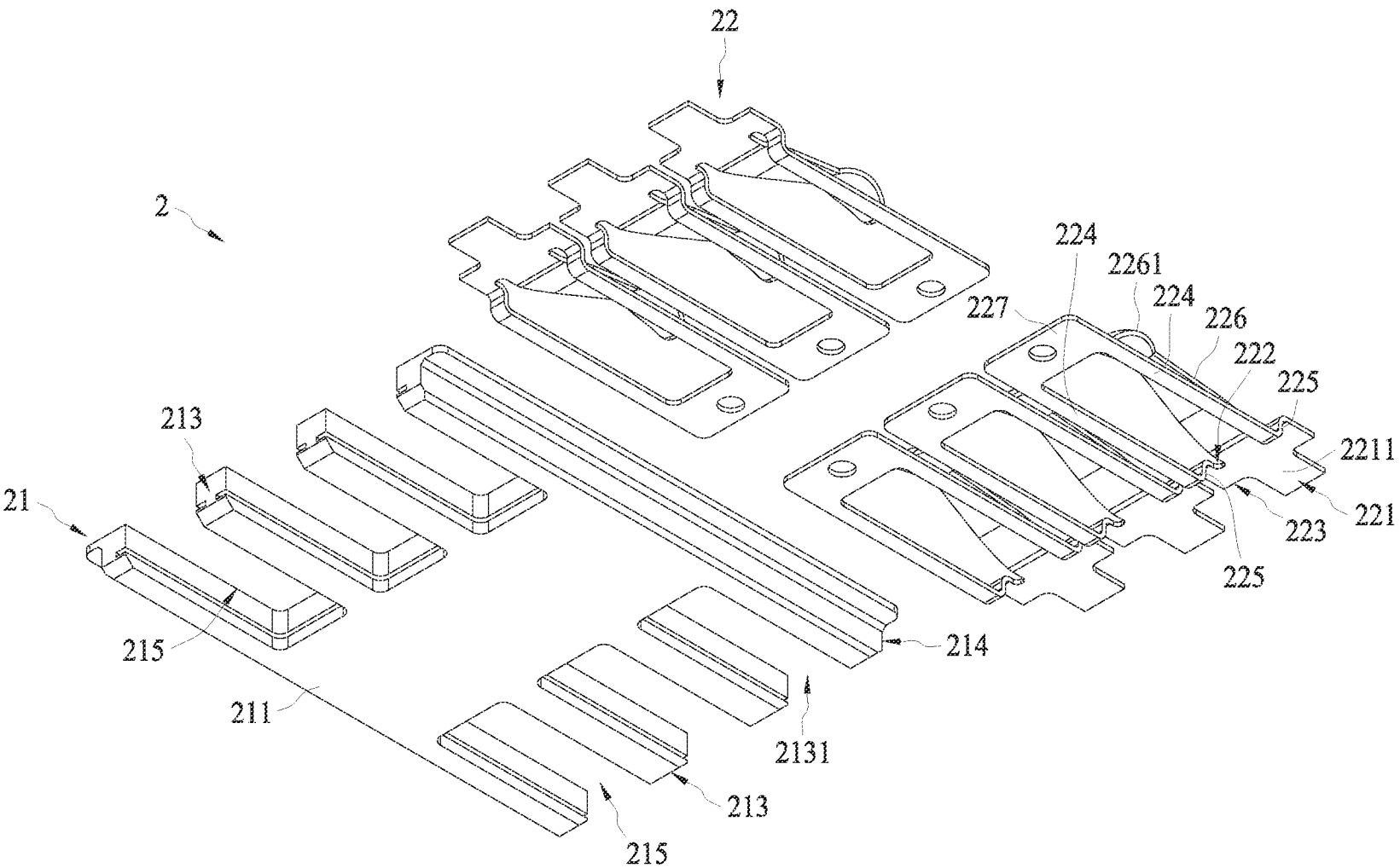
FIG. 6 shows a perspective exploded view of an electrical connector according to one embodiment.

FIG. 3 is a perspective view showing an embodiment of an electrical connector assembly 1. FIG. 4 shows a side view of the electrical connector assembly 1 of FIG. 3. FIG. 5 is a perspective exploded view of the electrical connector assembly 1 of FIG. 3. FIG. 6 shows a perspective exploded view of an electrical connector 2 according to one embodiment. Referring to FIGS. 3 and 4, the electrical connector assembly 1 may comprise an electrical connector 2 and a circuit board 3, on which the electrical connector 2 is mounted.

As shown in FIG. 5, the circuit board 3 may comprise a through-hole 31 that may be configured to receive a lower portion of the electrical connector 2 such that the electrical connector assembly 1 can be kept compact.

Referring to FIGS. 3 to 6, the electrical connector 2 may comprise a housing 21 and a plurality of terminals 22 attached to the housing 21. In some embodiments, the plurality of terminals 22 can be combined with the housing 21 by, but not limited to, an insert-molding process.

Referring to FIGS. 5 and 6, the housing 21 may be configured as a plate-like body. The housing 21 may comprise a bottom surface 211, an upper surface 212, opposite end portions 213, opposite side portions 214, and a plurality of openings 215. The bottom surface 211 may be opposite to the upper surface 212. The plurality of openings 215 may be formed through the housing 21 in a direction from the upper surface 212 to the bottom surface 211. The plurality of openings 215 may be formed adjacent to the opposite end portions 213. In some embodiments, the opening 215 may be a completely surrounded opening. In some other embodiments, the opening 215 may extend to the corresponding end portion 213, forming a corresponding aperture 2131 on the end portion 213.

Referring to FIGS. 5 and 6, the plurality of openings 215 correspond to the plurality of terminals 22. Each terminal 22 may comprise a base portion 221, a first edge 222, a second edge 223, two attaching portions 224, two connecting portions 225 corresponding to the two attaching portions 224, and an elastic arm portion 226, wherein the first edge 222 may be opposite the second edge 223. The two attaching portions 224 of each terminal 22 may extend parallel to each other, and may extend parallel to a direction from the corresponding second edge 223 to the corresponding first edge 222. In some embodiments, the two attaching portions 224 of each terminal 22 are configured to be lower than the corresponding base portion 221. Furthermore, the two connecting portions 225 of each terminal 22 may be disposed respectively adjacent to two opposite ends of the corresponding first edge 222 as shown in FIG. 5. Each of the two connecting portions 225 may be configured to connect the first edge 222 and the corresponding attaching portion 224. Moreover, the elastic arm portion 226 includes a contact part 2261. The elastic arm portion 226 may extend from a location between the opposite ends of the first edge 222. The elastic arm portion 226 of each terminal 22 may extend upward and along the direction extending from the corresponding second edge 223 to the corresponding first edge 222 with the contact part 2261 disposed above the corresponding opening 215.

In particular, the two attaching portions 224 of each terminal 22 are attached to the housing 21. As shown in FIG. 5, in some embodiments, the attaching portions 224 of each terminal 22 are inserted molded with the housing 21. In some embodiments, the attaching portions 224 of each terminal 22 are partially inserted in the housing 21.

Referring to FIG. 5, the two attaching portions 224 of each terminal 22 are disposed adjacent to the corresponding end portion 213 of the housing 21. The terminals 22 are disposed in accordance with the openings 215, and the two attaching portions 224 of each terminal 22 extend respectively on the opposite sides of the corresponding opening 215.

In some embodiments, the base portion 221 and the connecting portions 225 of each terminal 22 are disposed outside the corresponding end portion 213 of the housing 21 as shown in FIG. 5. As can be appreciated, the base portions 221 of the terminals 22 are large so that the base portions 221 are not easily deformed during manufacturing operations, and the base portions 221 can be kept on the same plane after the electrical connector 2 is manufactured. Moreover, the large base portions 221 may provide steady support to the electrical connector 2 after the electrical connector 2 is placed on the circuit board 3 before the electrical connector 2 is soldered.

As shown in FIG. 6, in some embodiments, the attaching portion 224 can be a cantilever member, and the distal ends of the two attaching portions 224 of each terminal 22 can be connected by an end connecting portion 227.

Figure 7:
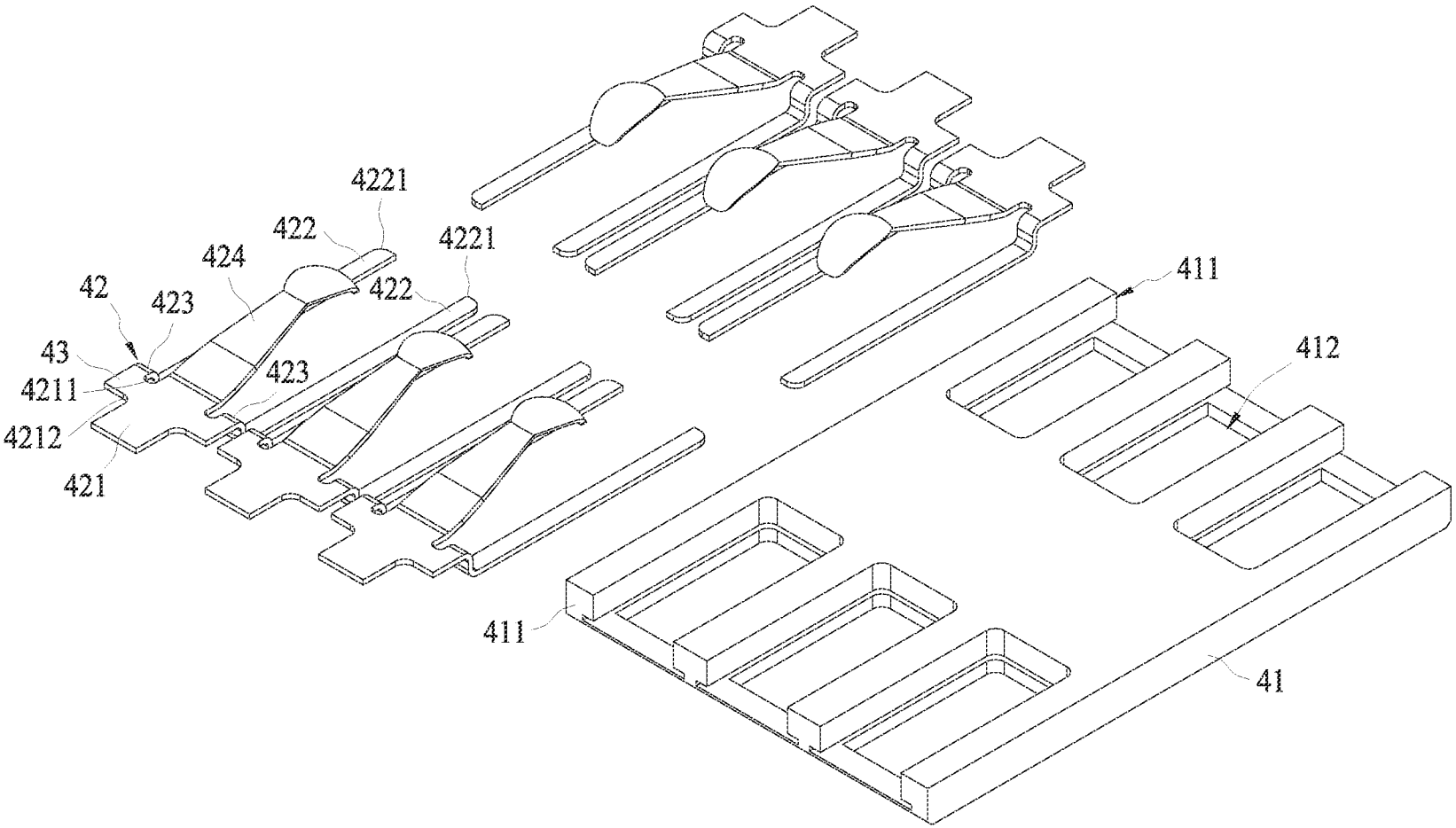
FIG. 7 is a view showing a housing and terminals according to another embodiment.

FIG. 7 is a view showing a housing 41 and terminals 42 according to another embodiment. As shown in FIG. 7, in some embodiments, the electrical connector 2 may comprise terminals 42 different from those disclosed in the embodiment of FIG. 6. The terminal 42 may comprise a base portion 421, two attaching portions 422, two connecting portions 423, and an elastic arm portion 424.

In each terminal 42, the elastic arm portion 424 is inclined upward from the base portion 421. The two attaching portions 422 and the base portion 421 are arranged at different heights. Each connecting portion 423 is configured to extend from a respective end of a first edge 4211, at least partially vertically extend, and connect the base portion 421 and the respective attaching portion 422. Each attaching portion 422 can extend in a direction from a second edge 4212 of the base portion 421 to the first edge 4211 of the base portion 421, can be a cantilever member, and can comprise a free distal end 4221.

The housing 41 may comprise two end portions 411 and a plurality of openings 412 corresponding to the terminals 42 and arranged along the two end portions 411. Each opening 412 is formed through housing 41 in addition to the part of the opening 412 adjacent to the respective end portion 411. Two attaching portions 422 of each terminal 42 are disposed adjacent to and extend on opposite sides of the corresponding opening 412. The base portion 421 and the connecting portions 423 of each terminal 42 may be disposed outside the respective end portion 411.

Referring back to FIGS. 3 and 5, the housing 21 may comprise two protrusions 216 disposed respectively on the opposite side portions 214, adjacent to the upper surface 212. The circuit board 3 may comprise an upper surface 32 and a plurality of soldering portions 33 corresponding to the plurality of terminals 22, disposed on the upper surface 32 and adjacent to opposite sides of the through-hole 31. The lower portion of at least the housing 21 or the electrical connector 2 is insertable into the through-hole 31 from the upper surface 32. After the electrical connector 2 is mounted on the circuit board 3, the base portions 221 of the terminals 22 and the protrusions 216 are on the circuit board 3. When an electrical card engages the electrical connector 2, depressing force depresses the elastic arm portions 226 of the terminals 22, and the depressing force is transmitted through the base portions 221 to the circuit board 3 such that the thin protrusions 216 can be protected from being broken. For example, the electrical card may be, but not limited to, a SIM card.

Referring to FIGS. 5 and 6 again, in some embodiments, the soldering portion 33 may comprise a soldering pad, and each terminal 22 comprises a solder surface 2211. The solder surface 2211 of each terminal 22 can be soldered to the corresponding soldering pad. In some embodiments, the base portion 221 of the terminal 22 is larger than the corresponding soldering portion 33 on the circuit board 3.

Figure 8:
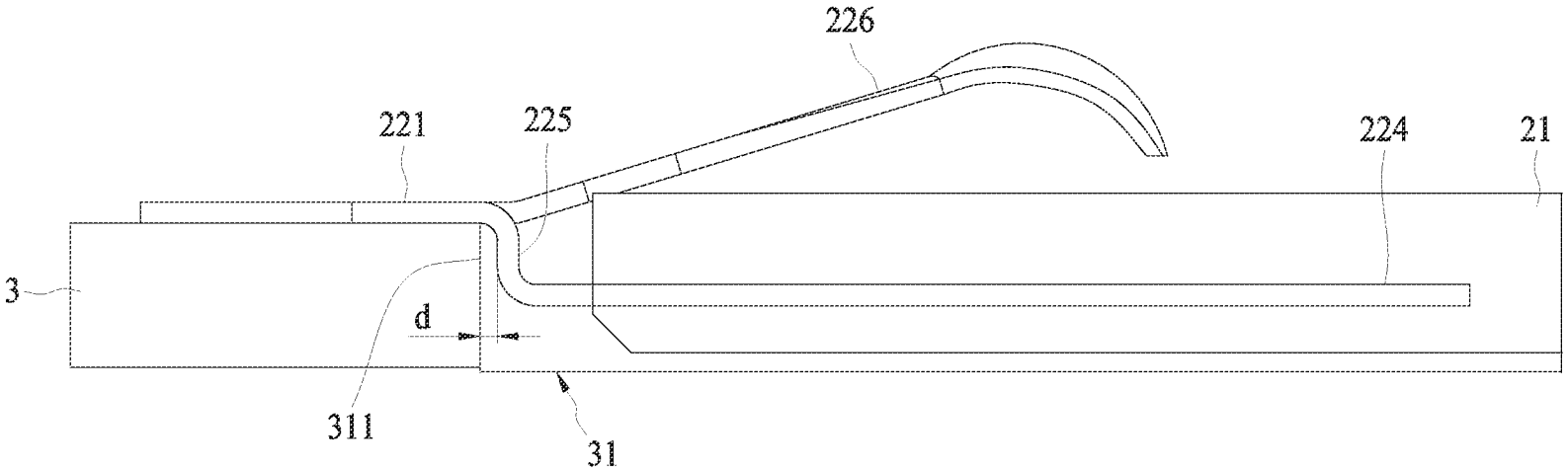
FIG. 8 is a cross-sectional view along line 1-1 in FIG. 3.

FIG. 8 is a cross-sectional view along line 1-1 in FIG. 3. As shown in FIG. 8, each connecting portion 225 connects the corresponding base portion 221 upon the circuit board 3 and the attaching portion 224 inserted in the housing 21. The connecting portion 225 can have a part extending vertically, along the side wall 311 defining the through-hole 31. In some embodiments, the connecting portion 225 of each terminal 22 at least partially received in the through-hole 31 may be gapped or separated from the corresponding side wall 311 defining the through-hole 31 by a distance d. The distance d allows the electrical connector 2 to be aligned relative to the through-hole 31 after the electrical connector 2 is mounted on the circuit board 3.

Figure 9:
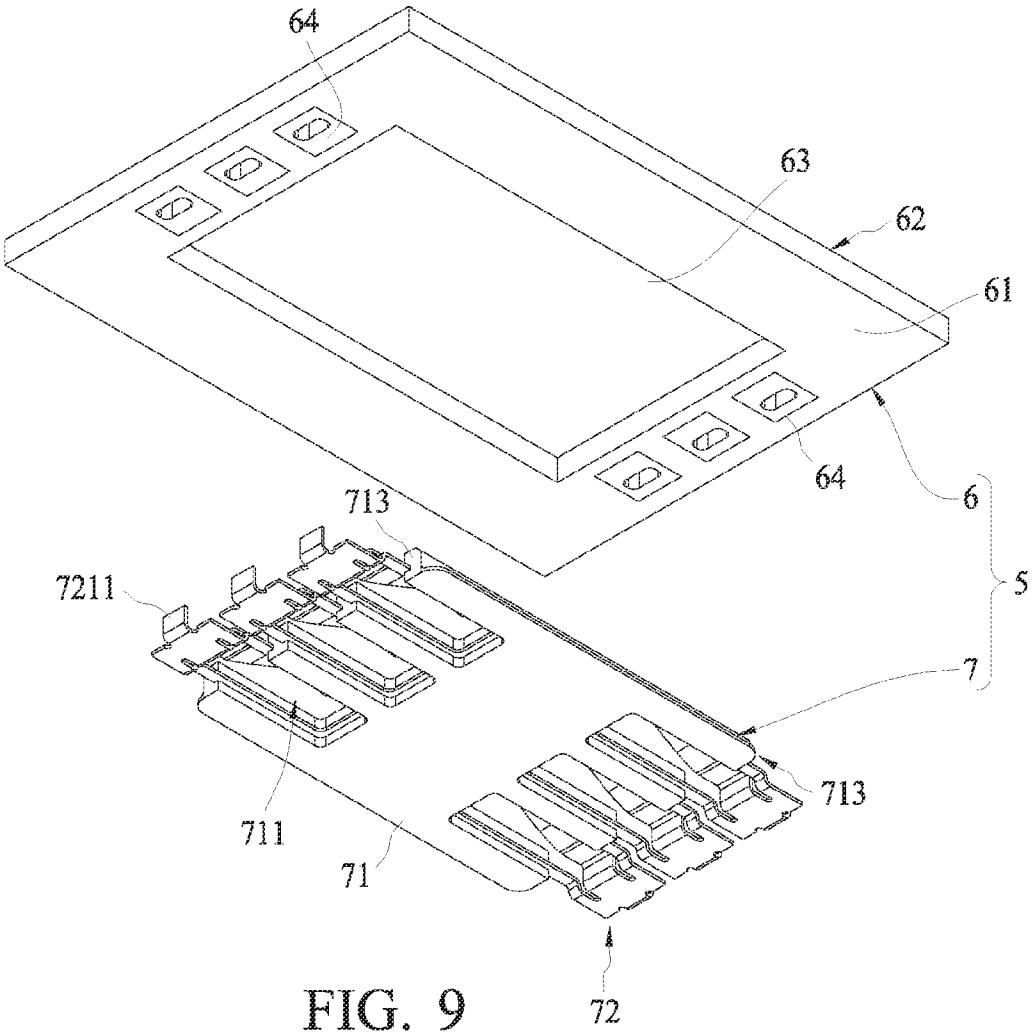
FIG. 9 is a perspective view showing an electrical connector assembly according to another embodiment.
Figure 10:
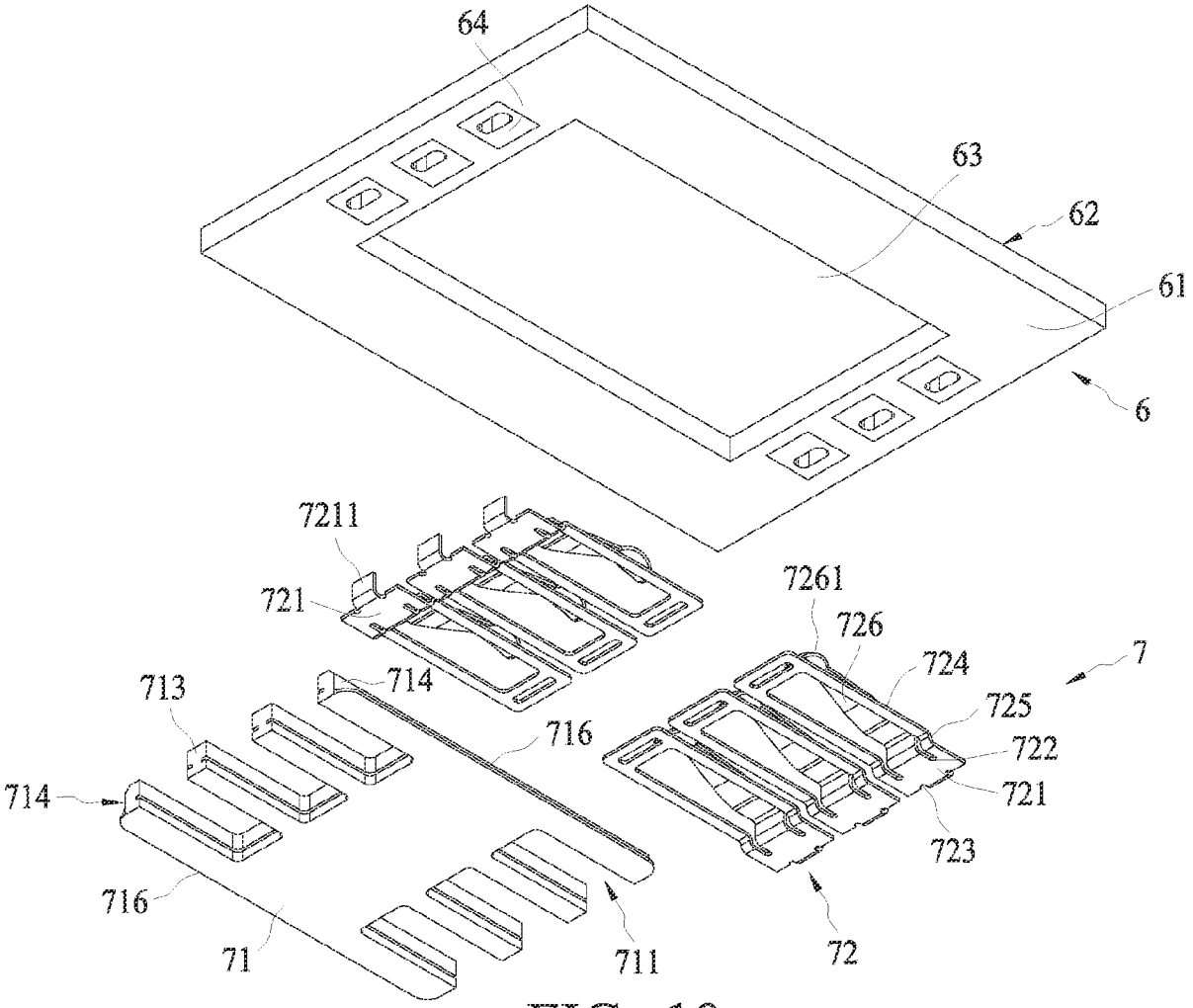
FIG. 10 is a perspective exploded view of the electrical connector assembly of FIG. 9.

FIG. 9 is a perspective view showing an electrical connector assembly 5 according to another embodiment. FIG. 10 is a perspective exploded view of the electrical connector assembly 5 of FIG. 9. Referring to FIGS. 9 and 10, the electrical connector assembly 5 may comprise a circuit board 6 and an electrical connector 7 comprising a housing 71 and a plurality of terminals 72 attached to the housing 71, wherein the electrical connector 7 is mounted underneath the circuit board 6.

The circuit board 6 can be a plate-like body and may comprise a bottom surface 61, an upper surface 62 opposite the bottom surface 61, a through-hole 63 configured to receive an upper portion of the electrical connector 7, and a plurality of soldering portions 64 disposed on the bottom surface 61 of the circuit board 6, being adjacent to opposite sides of the through-hole 63 and corresponding to the plurality of terminals 72. In the present embodiment, the soldering portion 64 comprises a soldering hole. With the soldering hole design, the terminals 72 can be more securely soldered onto the circuit board 6.

As shown in FIG. 10, each terminal 72 comprises a base portion 721, a first edge 722, a second edge 723 opposite the first edge 722, two attaching portions 724 extending parallel to a direction from the second edge 723 to the first edge 722 and formed higher than the base portion 721, two connecting portions 725 disposed respectively adjacent to two opposite ends of first edge 722 and each connecting the base portion 721 and the respective attaching portion 724, and an elastic arm portion 726 including a contact part 7261 disposed above the upper surface 62 of the circuit board 6 and extending from a location between the opposite ends of the first edge 722. Furthermore, the base portion 721 of each terminal 72 may comprise a soldering portion 7211 bent upward, configured to protrude into and be solderable in the corresponding soldering hole. The two attaching portions 724 of each terminal 72 can be cantilever members. In some embodiments, the distal ends of two attaching portions 724 of each terminal 72 can be connected. In some embodiments, the distal ends of two attaching portions 724 of each terminal 72 are not connected.

The plurality of terminal 72 can be, for example, insert-molded with the housing 71 comprising a plurality of openings 711 corresponding to the plurality of terminal 72. The plurality of openings 711 can be formed adjacent to two opposite end portions 713 and through the housing 71. In some embodiments, the openings 711 can extend to the corresponding end portions 713. In some embodiments, the attaching portions 724 of each terminal 72 are insert-molded with the housing 71, disposed on opposite sides of the corresponding opening 711, and the base portion 721 and the connecting portions 725 of each terminal 72 are disposed outside the corresponding end portion 713 of the housing 71.

When the electrical connector 7 is to be soldered to the circuit board 6, the circuit board 6 is initially placed with its bottom surface 61 facing upward. Next, the electrical connector 7 is mounted on the circuit board 6 with its upper portion or at least the upper portion of the housing 71 inserted into the through-hole 63 and the soldering portions 7211 of the terminals 72 inserted into the corresponding soldering portions 64 of the circuit board 6, which are configured as soldering holes in the present embodiment. Finally, a soldering process is performed to solder the soldering portions 7211 of the terminals 72 onto the soldering portions 64 of the circuit board 6. The base portion 721 of the terminal 72 is large so that the base portions 721 of the terminals 72 are not easily deformed during manufacturing operations and so that the base portions 721 of the terminals 72 can be kept on the same plane after the electrical connector 7 is manufactured. Moreover, with the large base portions 721 of the terminals 72, the electrical connector 7 can be mounted on the circuit board 6 stably before it is soldered.

Referring to FIG. 10, the housing 71 may further comprise protrusions 716 protruding laterally from the side portions 714, located adjacent to the bottom surface 61 of the circuit board 6, and configured to rest upon the circuit board 6 when the electrical connector 7 is placed on the circuit board 6. Similarly, the protrusions 716 are protected from being broken because most of depressing force exerted on the terminals 72 by an inserted electrical card is applied on the base portions 721 of the terminals 72.

Likewise, when the electrical connector 7 is mounted on the circuit board 6, the two connecting portions 725 of each terminal 72 may be located adjacent to and separated from the corresponding side wall defining the through-hole 63, allowing the adjustment of alignment of the electrical connector 7 relative to the through-hole 63.

Figure 11:
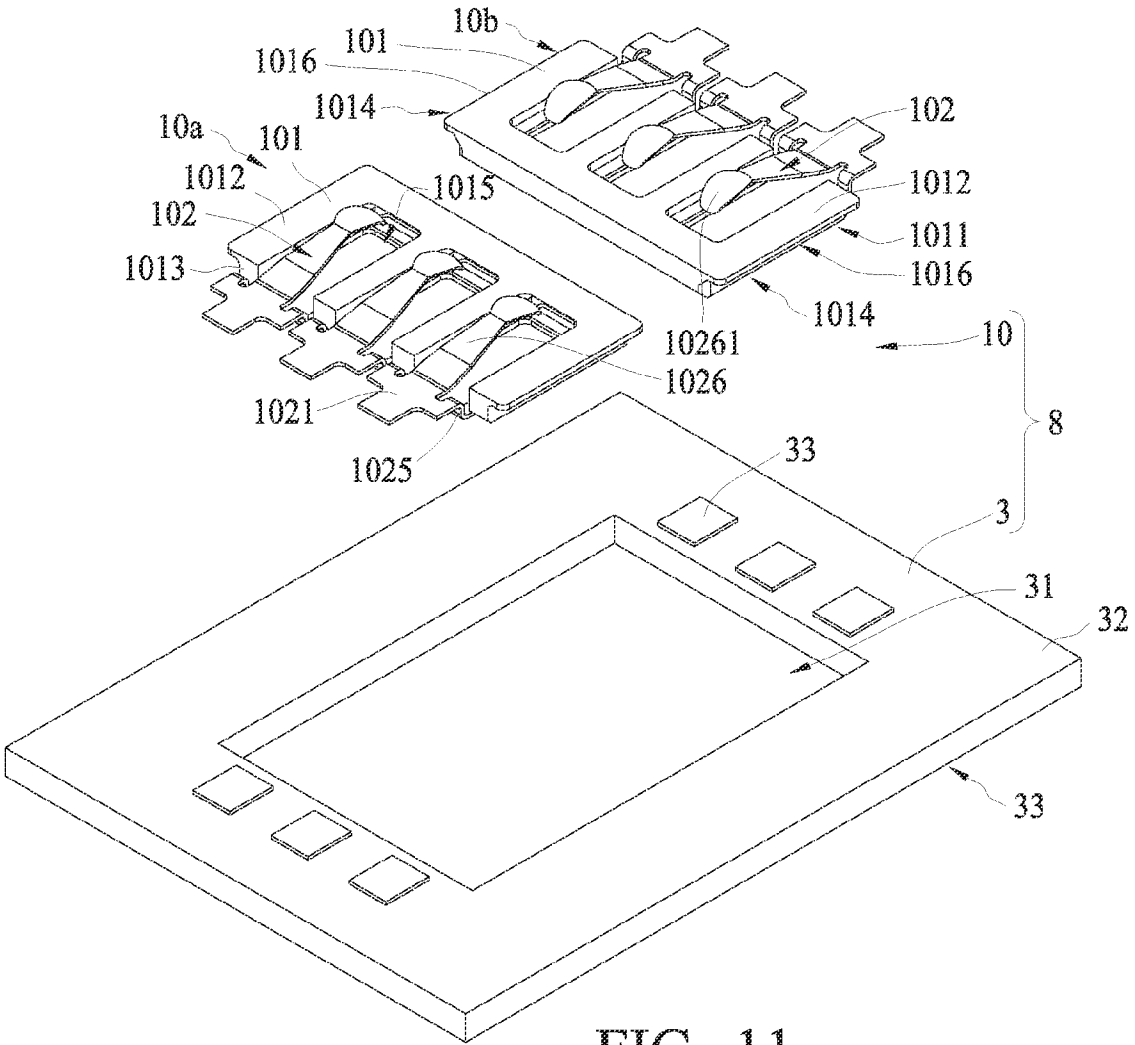
FIG. 11 is a perspective view showing an electrical connector assembly according to another embodiment.
Figure 12:
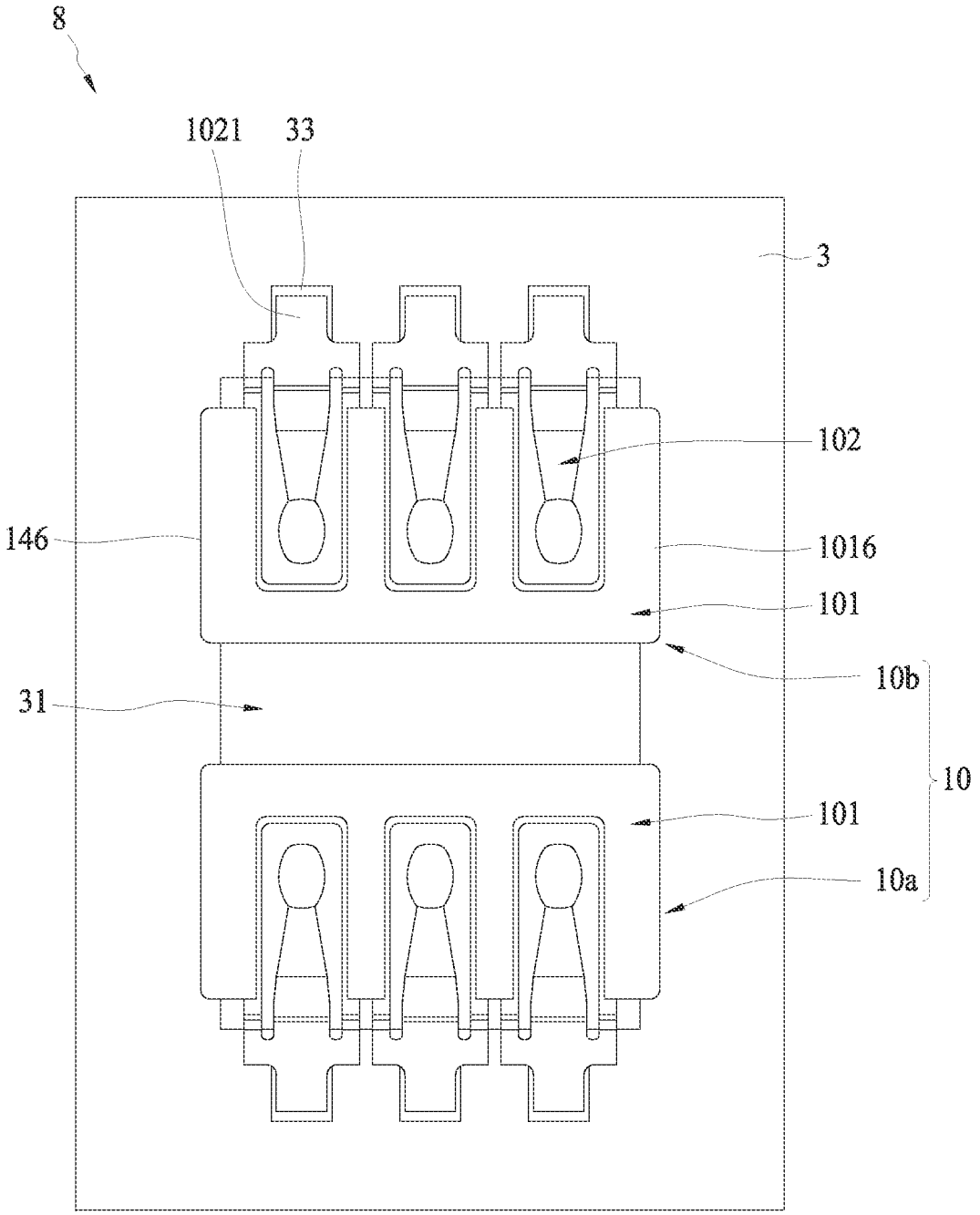
FIG. 12 is a top view showing an electrical connector assembly according to one embodiment.

FIG. 11 is a perspective view showing an electrical connector assembly 8 according to another embodiment. FIG. 12 is a top view showing an electrical connector assembly 8 according to one embodiment. Referring to FIGS. 11 and 12, the electrical connector assembly 8 may comprise a circuit board 3 including one through-hole 31 and an electrical connector 10 comprising two sub-connectors (10*a* and 10*b*) and mountable on the circuit board 3 with the lower portions of the two sub-connectors (10*a* and 10*b*) received within the through-hole 31.

The electrical connector 10 may comprise two plate-like insulating bodies 101 each including a plurality of openings 1015 and a plurality of terminals 102 corresponding to the openings 1015 of the two plate-like insulating bodies 101. The terminals 102 may be similar to the terminals 22 of the embodiment of FIG. 5 or the terminals 42 of the embodiment of FIG. 7. A portion of the openings 1015 may be disposed adjacent to an end portion 1013 of one housing 101, and each opening 1015 may extend to the end portion 1013 and be formed through from the upper surface 1012 to the bottom surface 1011. The plurality of terminals 102 may be arranged along the end portions 1013 of the insulating bodies 101, and each terminal 102 may be, for example, insert-molded with the corresponding housing 101 with its base portion 1021 and connecting portion 1025 disposed outside the corresponding end portion 1013 and with the contact part 10261 of the elastic arm portion 1026 disposed above the upper surface 1012 of the housing 101.

Each terminal 102 may include two attaching portions at least partially attached to the corresponding housing 101, adjacent to the corresponding end portion 1013. In some embodiments, the openings 1015 can be formed through from the upper surface 1012 to the bottom surface 1011 of the housing 101.

The circuit board 3 comprises a plurality of soldering portions 33 disposed adjacent to two opposite sides of the through-hole 31. The base portion 1021 of each terminal 102 may comprise a soldering surface, and each electrical sub-connector (10*a* or 10*b*) is disposed near one side of the through-hole 31 with the soldering surfaces of the terminals 102 placed correspondingly against the soldering portions 33 as shown in FIG. 12.

Referring to FIGS. 11 and 12, each housing 101 may comprise a plurality of protrusions 1016 disposed respectively on the side portions 1014 of the housing 101. The protrusions 1016 are against the upper surface 32 of the circuit board 3 when the corresponding electrical sub-connector (10*a* or 10*b*) is mounted.

Similarly, when the electrical sub-connector (10*a* or 10*b*) is mounted on the circuit board 3, the connecting portions 1025 of each terminal 102 are placed adjacent to a corresponding side wall defining the through-hole 31. In some embodiments, the connecting portions 1025 of each terminal 102 are separated from the corresponding side wall defining the through-hole 31.

Figure 13:
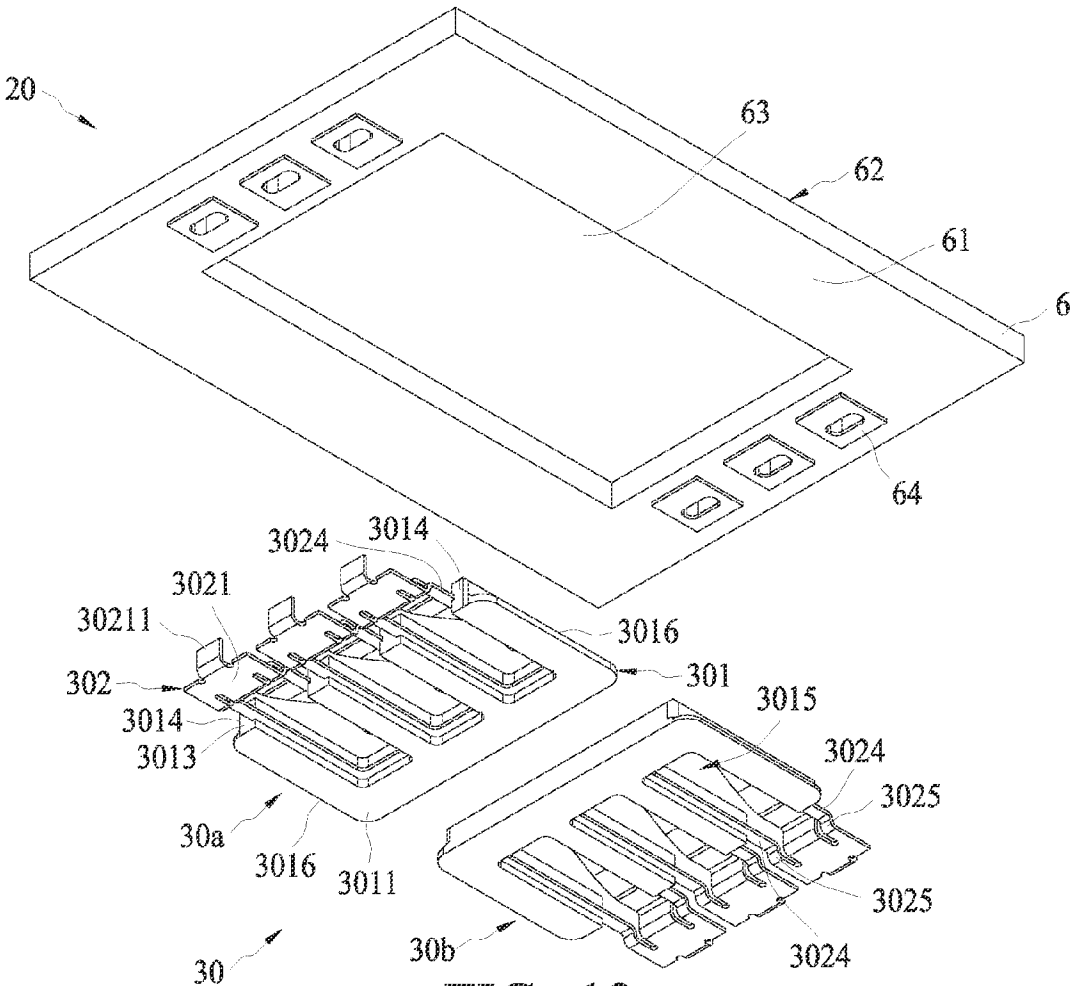
FIG. 13 is a perspective view showing an electrical connector assembly according to another embodiment.

FIG. 13 is a perspective view showing an electrical connector assembly 20 according to another embodiment. The electrical connector assembly 20 may comprise a circuit board 6 including a bottom surface 61 and an electrical connector 30 including a plurality of electrical sub-connectors (30*a* and 30*b*) configured to be attached to the bottom surface 61 of the circuit board 6. The electrical sub-connectors (30*a* and 30*b*) are similar to the electrical sub-connectors (10*a* and 10*b*) of the embodiment of FIG. 11 except that the soldering portion 30211 of the base portion 3021 of the terminal 302 is bent upward so as to be insertable into the respective soldering portion 64 that is configured as a soldering hole in the present embodiment and the attaching portions 3024 are higher than the base portion 3021 in each terminal 302.

The attaching portions 3024 of each terminal 302 can be insert-molded with the housing 301 with the connecting portions 3025 and the base portion 3021 disposed outside one end portion 3013 of the housing 301. An opening 3015 is formed between the two attaching portions 3024 of each terminal 302. The opening 3015 can be a through opening and may extend to the end portion 3013. The housing 301 may comprise two protrusions 3016 extending laterally, respectively from the side portions 3014. The protrusions 3016 are configured to be against the bottom surface 61 of the circuit board 6. Similarly, the connecting portions 3025 of each terminal 302 can be adjacent to and separated from a corresponding side wall defining the through-hole 63 of the circuit board 6 when the electrical connector 30 is installed on the circuit board 6.

When the electrical sub-connectors (30*a* and 30*b*) are to be soldered to the circuit board 6, the circuit board 6 is initially placed with its bottom surface 61 facing upward. Next, the electrical sub-connectors (30*a* and 30*b*) are mounted on the circuit board 6 with their upper portions or at least the upper portions of the insulating bodies 301 inserted into the through-hole 63, the protrusions 3016 being against the bottom surface 61 of the circuit board 6, and the soldering portions 30211 of the terminals 302 are inserted into the corresponding soldering portions 64 of the circuit board 6, which are configured as soldering holes in the present embodiment. Finally, a soldering process is performed to solder the soldering portions 30211 of the terminals 302 onto the soldering portions 64 of the circuit board 6.

Figure 14:
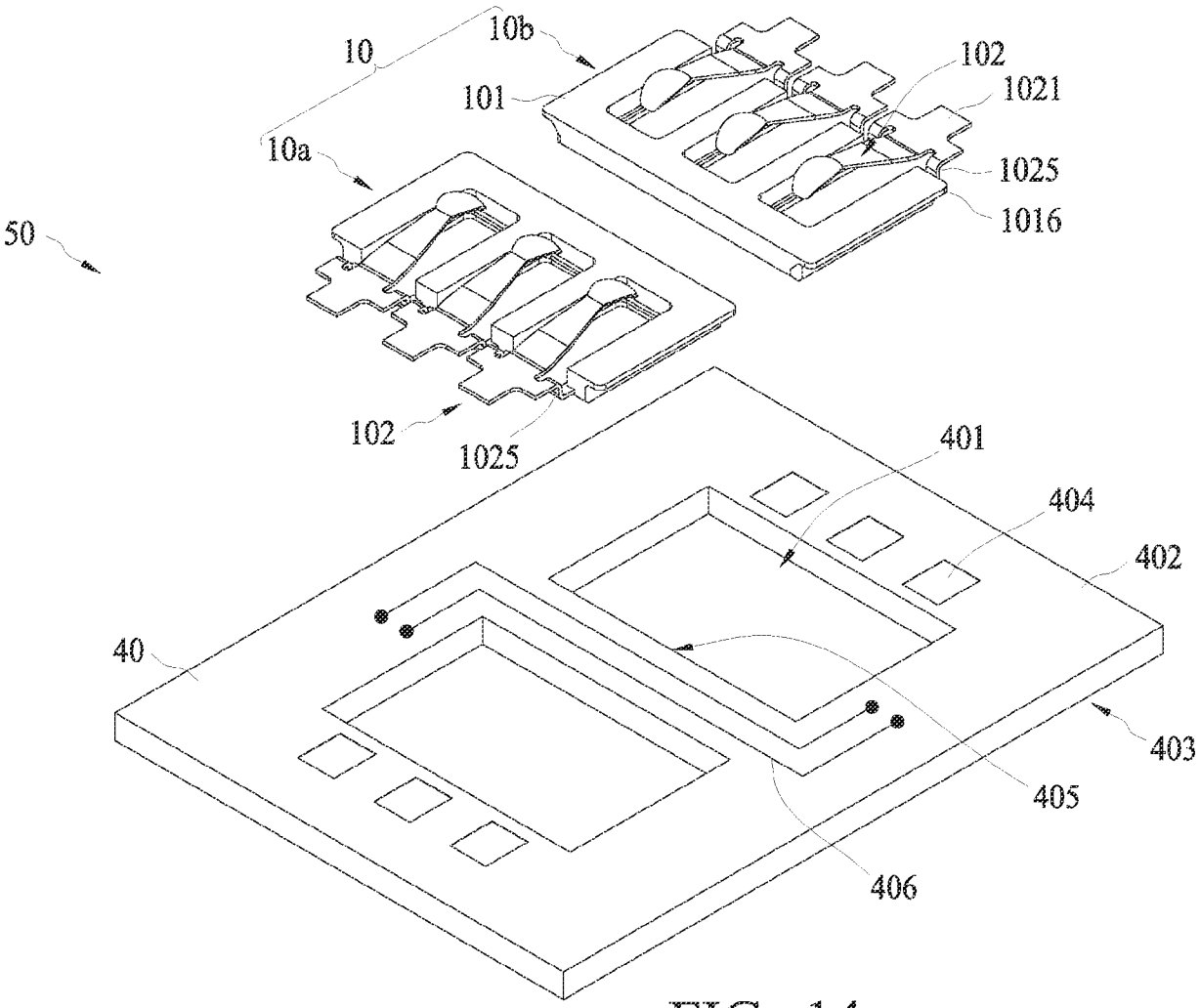
FIG. 14 is a perspective view showing an electrical connector assembly according to another embodiment.

FIG. 14 is a perspective view showing an electrical connector assembly 50 according to still yet another embodiment. As shown in FIG. 14, the electrical connector assembly 50 may comprise an electrical connector 10 as disclosed in the embodiment of FIG. 10 and a circuit board 40 comprising two through-holes 401 corresponding to the sub-connectors (10*a* and 10*b*) of the electrical connector 10, an upper surface 402, a bottom surface 403 opposite the upper surface 402, and a plurality of soldering portions 404 formed on the upper surface 402 for electrically coupling with the electrical connector 10. The two through-holes 401 can be arranged adjacent to each other, and the plurality of soldering portions 404 may be disposed adjacent to the farthest opposite sides of the two through-holes 401. Each through-hole 401 is configured to at least receive a lower portion of the respective sub-connector (10*a* and 10*b*) or at least the respective housing 101.

When the electrical connector 10 is placed on the circuit board 40, the portion of each housing 101 below the protrusions 1016 formed adjacent to the upper surface 101 and at least a part of connecting portions 1025 of the corresponding terminals 102 enter the respective through-hole 401, and the base portions 1021 of the terminals 102 and the protrusions 1016 rest upon the upper surface 402 of the circuit board 40. The connecting portions 1025 of the terminal 102 can be adjacent to a corresponding side wall defining the through-hole 401. In some embodiments, the connecting portions 1025 of the terminal 102 may be separated from the corresponding side wall defining the through-hole 401. In some embodiments, the soldering portion 404 comprises a soldering pad configured to be soldered with the solder portion, which comprises a corresponding solder surface in the present embodiment, of the base portion 1021 of the respective terminal 102.

As illustrated in FIG. 14, the circuit board 40 may have a section 405 extending between the two through-holes 401. The arrangement of the section 405 provides a greater usable area on the circuit board 40. In some embodiments, the circuit board 40 may comprise at least one trace 406 passing through the section 405. In some embodiments, a portion of a circuit is formed on the section 405.

Figure 15:
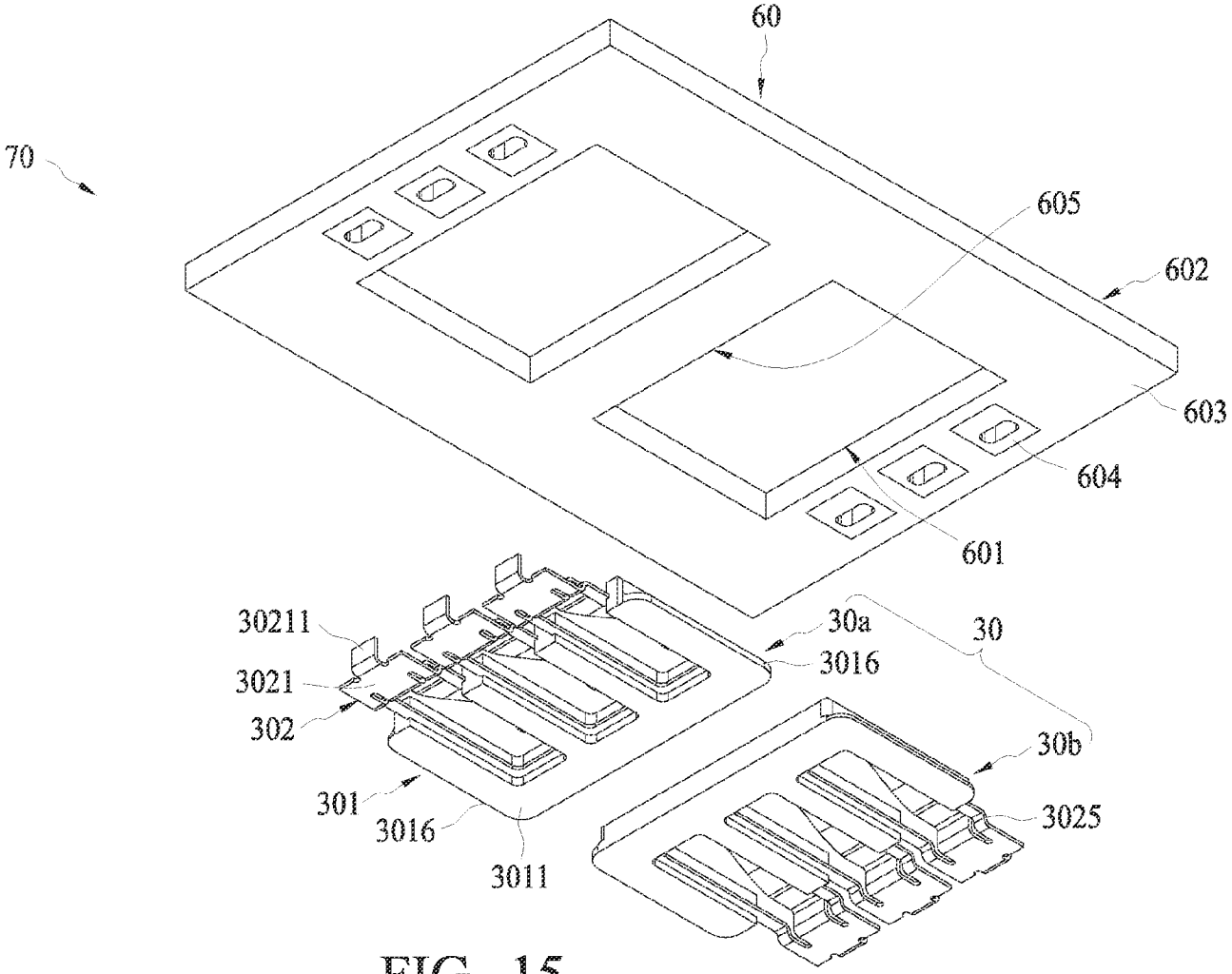
FIG. 15 is a perspective view showing an electrical connector assembly according to another embodiment.

FIG. 15 is a perspective view of another embodiment, showing an electrical connector assembly 70. As shown in FIG. 15, the electrical connector assembly 70 may comprise an electrical connector 30 as disclosed in the embodiment of FIG. 13 and a circuit board 60 comprising two through-holes 601 corresponding to the two electrical sub-connectors (30*a* and 30*b*) of the electrical connector 30, an upper surface 602, a bottom surface 603 opposite to the upper surface 602, and a plurality of soldering portions 604 formed on the bottom surface 603 for electrically coupling with the electrical connector 30. The two through-holes 601 can be arranged adjacent to each other, and the plurality of soldering portions 604 may be disposed adjacent to the farthest opposite sides of the two through-holes 601. Each through-hole 601 is configured to at least receive an upper portion of the respective electrical sub-connector (30*a* or 30*b*).

When the electrical sub-connectors (30*a* and 30*b*) are to be soldered to the circuit board 60, the circuit board 60 is initially placed with its bottom surface 603 facing upward. Next, the electrical sub-connectors (30*a* and 30*b*) are mounted on the circuit board 60 with their upper portions or at least the upper portions of the insulating bodies 301 inserted respectively into the through-holes 601, the protrusions 3016 being against the bottom surface 603 of the circuit board 60, and the soldering portions 30211 of the terminals 302 inserted into the corresponding soldering portions 604 of the circuit board 60, which are configured as soldering holes in the present embodiment. Finally, a soldering process is performed to solder the soldering portions 30211 of the terminals 302 onto the soldering portions 604 of the circuit board 60.

When the electrical connector 30 is placed on the circuit board 60, the portion of each housing 301 above the protrusions 3016 formed adjacent to the bottom surface 3011 and at least a part of connecting portions 3025 of the terminals 302 enter the respective through-hole 601, and the base portions 3021 of the terminals 302 and the protrusions 3016 are against the bottom surface 603 of the circuit board 60. The connecting portions 3025 of the terminal 302 are adjacent to a corresponding side wall defining the through-hole 601. In some embodiments, the connecting portions 3025 of the terminal 302 may be separated from the corresponding side wall defining the through-hole 601. In some embodiments, the soldering portion 604 comprises a soldering hole configured to receive the solder portion 30211, bent upward in the present embodiment, of the base portion 3021 of the respective terminal 302.

As illustrated in FIG. 15, the circuit board 60 may have a section 605 extending between the two through-holes 601. The arrangement of the section 605 provides a greater usable area on the circuit board 60. In some embodiments, the circuit board 60 may comprise at least one trace passing through the section 605 as demonstrated in the embodiment of FIG. 14. In some embodiments, a portion of a circuit can be formed on the section 605.

In some embodiments, an electrical connector assembly can comprise an electrical connector that only has one terminal. The electrical connector of such electrical connector assembly can be applied to an application that needs only one terminal. In some embodiments, the electrical connector with one terminal can be used for grounding.

Figure 16:
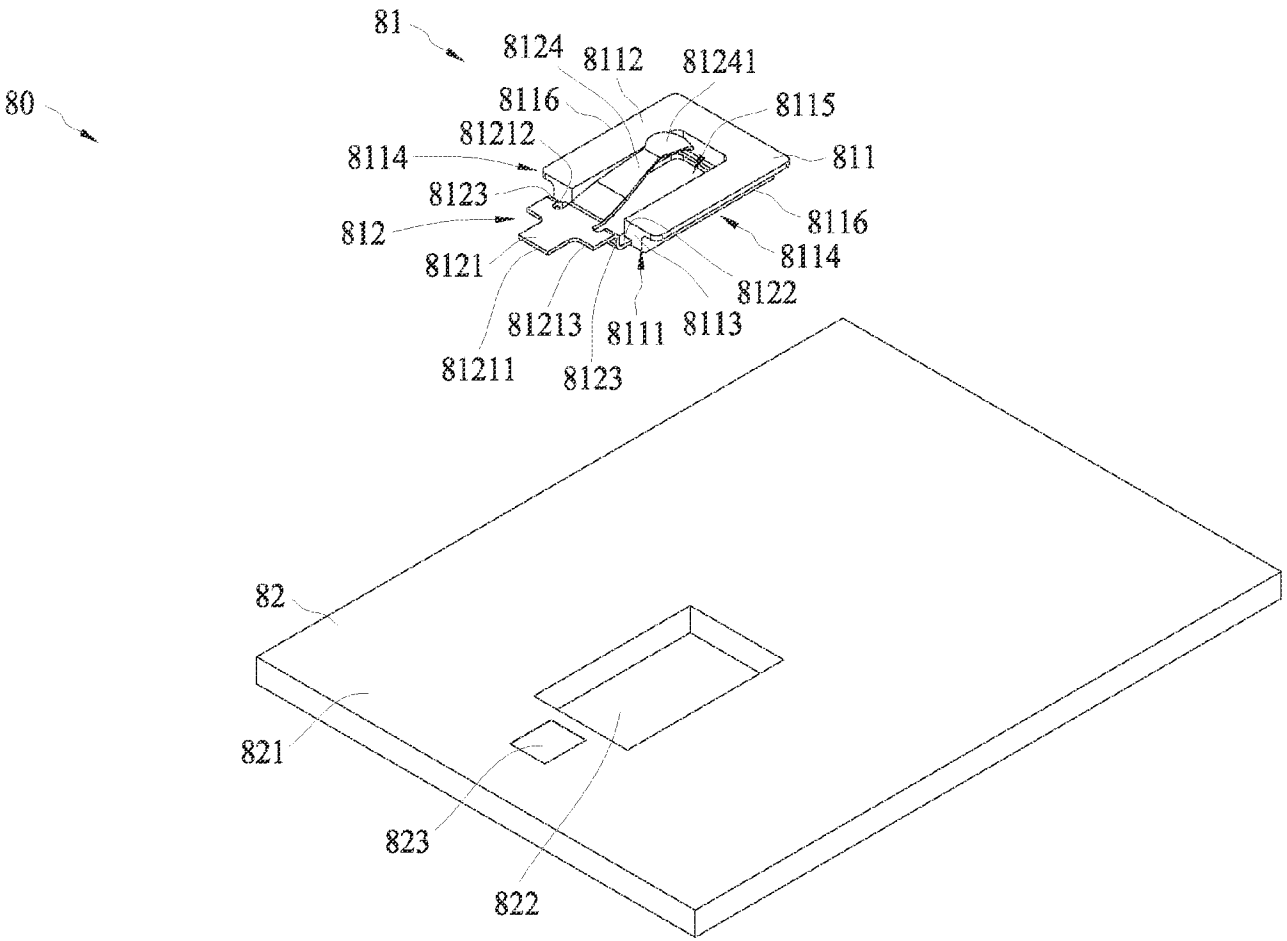
FIG. 16 is a perspective view showing an electrical connector assembly according to another embodiment.

FIG. 16 is a perspective view showing an electrical connector assembly 80 according to another embodiment. As shown in FIG. 16, the electrical connector assembly 80 comprises an electrical connector 81 mountable on a circuit board 82 comprising an upper surface 821, a through hole 822 configured to receive a portion of the electrical connector 81 and a soldering portion 823 disposed on the upper surface 821 and adjacent to the through hole 822. The electrical connector 81 may comprise a housing 811 that is configured as a plate-like body and a terminal 812. The housing 811 may comprise a bottom surface 8111, an upper surface 8112 opposite the bottom surface 8111, an end portion 8113, opposite side portions 8114, and an opening 8115 formed from the upper surface 8112 to the bottom surface 8111 and disposed adjacent to the end portion 8113. The terminal 812 may comprise a base portion 8121, two attaching portions 8122, two connecting portions 8123, and an elastic arm portion 8124. The base portion 8121 comprises a soldering portion 81211, a first edge 81212, and a second edge 81213. The attaching portions 8122 extend parallel to the direction extending from the second edge 81213 to the first edge 81212, are configured to have a height lower than that of the base portion 8121, and to extend on opposite sides of the opening 8115. The connecting portions 8123 respectively disposed adjacent to the opposite ends of the first edge 81212. The connecting portions 8123 correspondingly connect the first edge 81212 and the attaching portions 8122. The elastic arm portion 8124 includes a contact part 81241. The elastic arm portion 8124 extends, from a location between the opposite ends of the first edge 81212, upward and along the direction extending from the second edge 81213 to the first edge 81212 with the contact part 81241 above the opening 8115.

The two attaching portions 8122 of the terminal 812 are attached to the housing 811. The two attaching portions 8122 may be disposed adjacent to the end portion 8113 of the housing 811 and respectively on opposite sides of the opening 8115. The attaching portion 8122 may be a cantilever member. The distal ends of the two attaching portions 8122 can be connected or separated.

The base portion 8121 and the connecting portions 8123 of the terminal 812 are disposed outside the end portion 8113 of the housing 811 as shown in FIG. 16. The base portion 8121 of the terminal 812 is configured to be sufficiently large so that the base portion 8121 is not easily deformed during manufacturing operations and allow the electrical connector 81 to be stably supported on the circuit board 82. In some embodiments, the opening 8115 may extend to the end portion 8113 of the housing 811.

The housing 811 may comprise two protrusions 8116 disposed respectively on the opposite side portions 8114 of the housing 811. As depicted, the protrusions 8116 are disposed adjacent to the upper surface 821 of the housing 811.

When the electrical connector 81 is mounted on the circuit board 82, at least a portion of the housing 811 is received in the through-hole 822, the connecting portions 8123 of the terminal 812 are adjacent to and separated from a corresponding side wall defining the through-hole 822, and the soldering portion 81211 of the terminal 812 is solderable to the soldering portion 823 of the circuit board 82. In some embodiments, the soldering portion 81211 of the terminal 812 comprises a soldering surface solderable onto the soldering portion 823. Because the soldering portion 81211 of the terminal 812 rests on the circuit board 82, depressing force applied upon the contact part 81241 of the terminal 812 by an inserted electrical card is transmitted through the base portion 8121 of terminal 812 to the circuit board 82. Therefore, the housing 811 is not easily deformed and the protrusions 8116 of the housing 811 engaging the circuit board 82 can be protected from being broken.

Figure 17:
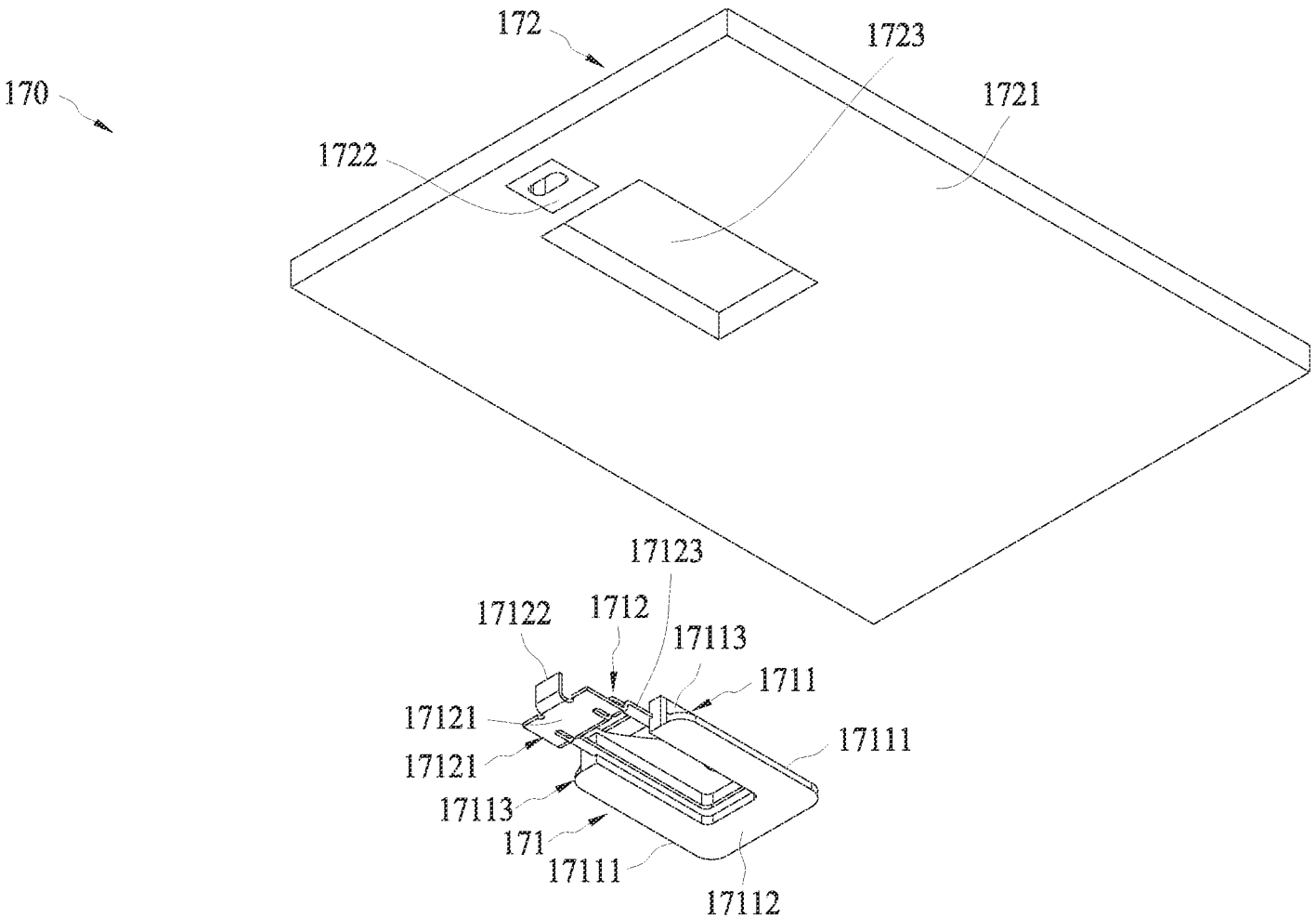
FIG. 17 is a perspective view showing an electrical connector assembly according to another embodiment.

FIG. 17 is a perspective view showing an electrical connector assembly 170 according to another embodiment. The electrical connector assembly 170 comprises an electrical connector 171 and a circuit board 172.

The electrical connector 171 is similar to the electrical connector 81 of the embodiment shown in FIG. 16 except that the electrical connector 171 is configured to be installed on the bottom surface 1721. The protrusions 17111 respectively disposed on two side portions 17113 of the housing 1711 are disposed adjacent to the bottom surface 17112 of the housing 1711. In addition, the base portion 17121 of the terminal 1712 is configured to be lower than the two attaching portion 17123 so that the base portion 17121 can rest on the bottom surface 1721 of the circuit board 172 when at least a portion of the housing 1711 enters the through hole 1723. Moreover, the soldering portion 1722 of the circuit board 172 is configured as a soldering hole, and the soldering portion 17122 of the terminal 1712 is bent upward to protrude into the soldering hole when the electrical connector 171 is mounted. The base portion 17121 of the terminal 1712 is configured to be sufficiently large so that the base portion 17121 is not easily deformed during manufacturing operations and allow the electrical connector 171 to be stably supported on the circuit board 172.

Embodiments disclose at least one terminal held by a housing of an electrical connector comprising a base portion engaging a surface of a circuit board when the electrical connector is attached to the circuit board. The base portion is configured to be sufficiently large so that the base portion is not easily deformed during manufacturing operations. Embodiments disclose an electrical connector comprising a housing configured to hold terminals comprising base portions that engage a surface of a circuit board when the electrical connector is mounted on the circuit board and that can be kept on the same plane after the electrical connector is manufactured. Further, the larger base portion(s) may allow the electrical connector to be stably supported on the circuit board. Moreover, depressing force applied upon the contact part of the terminal by an inserted electrical card is transmitted through the base portion of terminal to the circuit board. Therefore, the housing is not easily deformed and the protrusions of the housing engaging the circuit board can be protected from being broken.

The above-described embodiments of the present invention are intended to be illustrative only. Numerous alternative embodiments may be devised by persons skilled in the art without departing from the scope of the following claims.

What is claimed is:

1. A connector, comprising:

a housing configured as a plate-like body, comprising a bottom surface, an upper surface opposite the bottom surface, opposite end portions, opposite side portions, and a plurality of openings formed from the upper surface to the bottom surface and being adjacent to the opposite end portions; and a plurality of terminals corresponding to the plurality of openings, each terminal comprising a base portion including a soldering portion and opposite first and second edges, two attaching portions extending parallel to a direction from the second edge to the first edge and configured to have a height different from that of the base portion, two connecting portions respectively disposed adjacent to opposite ends of the first edge and correspondingly connecting the first edge and the attaching portions, and an elastic arm portion including a contact part and extending, from a location between the ends of the first edge, upward and along the direction from the second edge to the first edge with the contact part above the corresponding opening;

wherein the two attaching portions of each terminal are attached to the housing, disposed adjacent to the corresponding end portion of the housing and respectively on opposite sides of the corresponding opening, and wherein the base portion and the connecting portions of each terminal are disposed outside the corresponding end portion.

2. The connector of claim 1, wherein each opening extends to the corresponding end portion of the housing.

3. The connector of claim 1, wherein the attaching portion is a cantilever member.

4. The connector of claim 3, wherein distal ends of the attaching portions of each terminal are connected.

5. The connector of claim 1, wherein the housing comprises two protrusions disposed respectively on the side portions of the housing and being adjacent to the upper or bottom surface of the housing.

6. The connector of claim 5, further comprising a circuit board including a through-hole and a plurality of soldering portions disposed adjacent to opposite sides of the through-hole, wherein the soldering portions of the circuit board are on an upper surface of the circuit board if the attaching portions of each terminal are lower than the corresponding base portion, and the soldering portions of the circuit board are on a bottom surface of the circuit board if the attaching portions of each terminal are higher than the corresponding base portion, wherein when the electrical connector is mounted on the circuit board, a portion of the housing is in the through-hole, the connecting portions of each terminal are adjacent to and separated from a corresponding side wall defining the through-hole, and the soldering portions of the terminals are solderable to the corresponding soldering portions of the circuit board.

7. The connector of claim 6, wherein the soldering portion of the circuit board comprises a soldering pad, and the soldering portion of each terminal comprises a soldering surface.

8. The connector of claim 6, wherein the soldering portion of the circuit board comprises a soldering hole, and the soldering portion of each terminal is configured to protrude into a corresponding one of the soldering holes.

9. An connector assembly, comprising:

a circuit board, the circuit board including a through-hole and a plurality of soldering portions disposed adjacent to opposite sides of the through-hole;

a connector mounted on the circuit board, the connector including two housings configured as plate-like bodies, each housing comprising a bottom surface, an upper surface opposite to the bottom surface, an end portion, opposite side portions, a plurality of openings formed from the upper surface to the bottom surface and being adjacent to the end portion, and two protrusions disposed respectively on the side portions; and a plurality of terminals corresponding to the openings of the two insulating bodies, each terminal comprising a base portion including a soldering portion and opposite first and second edges, two attaching portions extending parallel to a direction from the second edge to the first edge, two connecting portions respectively disposed adjacent to opposite ends of the first edge and correspondingly connecting the first edge and the attaching portions, and an elastic arm portion including a contact part and extending, from a location between the ends of the first edge, upward and along the direction from the second edge to the first edge with the contact part above the corresponding opening;

wherein the two attaching portions of each terminal are attached to the corresponding housing, disposed adjacent to the corresponding end portion and respectively on opposite sides of the corresponding opening and wherein the base portion and the connecting portions of each terminal are disposed outside the corresponding end portion;

wherein the attaching portions of each terminal are lower than the corresponding base portion, the soldering portions of the circuit board are on an upper surface of the circuit board and the protrusions of each housing are against the upper surface of the circuit board and wherein a portion of each housing is in the through-hole, the connecting portions of each terminal are adjacent to and separated from a corresponding side wall defining the through-hole, and the soldering portions of the terminals are solderable to the corresponding soldering portions of the circuit board.

10. The electrical connector assembly of claim 9, wherein each opening extends to the corresponding end portion of the housing.

11. The electrical connector assembly of claim 9, wherein the attaching portion is a cantilever member.

12. The electrical connector assembly of claim 11, wherein distal ends of the attaching portions of each terminal are connected.

13. The electrical connector assembly of claim 12, wherein the soldering portion of the circuit board comprises a soldering pad, and the soldering portion of each terminal comprises a soldering surface.

14. The electrical connector assembly of claim 12, wherein the soldering portion of the circuit board comprises a soldering hole, and the soldering portion of each terminal is configured to protrude into a corresponding one of the soldering holes.

15. A connector, comprising:

a housing configured as a plate-like body, comprising a bottom surface, an upper surface opposite the bottom surface, an end portion, opposite side portions, and an opening formed from the upper surface to the bottom surface and being adjacent to the end portion; and a terminal comprising a base portion including a soldering portion and opposite first and second edges, two attaching portions extending parallel to a direction from the second edge to the first edge and configured to have a height different from that of the base portion, two connecting portions respectively disposed adjacent to opposite ends of the first edge and correspondingly connecting the first edge and the attaching portions, and an elastic arm portion including a contact part and extending, from a location between the ends of the first edge, upward and along the direction from the second edge to the first edge with the contact part above the opening;

wherein the two attaching portions of the terminal are attached to the housing, disposed adjacent to the end portion of the housing and respectively on opposite sides of the opening and wherein the base portion and the connecting portions of the terminal are disposed outside the end portion of the housing.

16. The connector of claim 15, wherein the opening extends to the end portion of the housing.

17. The connector of claim 15, wherein the attaching portion is a cantilever member, wherein distal ends of the attaching portions of the terminal are connected or separated.

18. The connector of claim 15, wherein the housing comprises two protrusions disposed respectively on the side portions of the housing and being adjacent to the upper or bottom surface of the housing.

19. An electrical connector assembly, comprising:

a connector as claimed in claim 15; and a circuit board including a through-hole and a soldering portion disposed adjacent to the through-hole, wherein the soldering portion of the circuit board is on an upper surface of the circuit board and the attaching portions of the terminal are lower than the base portion, wherein the electrical connector is mounted on the circuit board such that a portion of the housing is in the through-hole, the connecting portions of the terminal are adjacent to and separated from a corresponding side wall defining the through-hole, and the soldering portion of the terminal is solderable to the soldering portion of the circuit board.

20. An electrical connector assembly, comprising:

a connector as claimed in claim 15; and a circuit board including a through-hole and a soldering portion disposed adjacent to the through-hole, wherein the soldering portion of the circuit board is on a bottom surface of the circuit board and the attaching portions of the terminal are above than the base portion, wherein the electrical connector is mounted on the circuit board such that a portion of the housing is in the through-hole, the connecting portions of the terminal are adjacent to and separated from a corresponding side wall defining the through-hole, and the soldering portion of the terminal is solderable to the soldering portion of the circuit board.

21. The electrical connector assembly of claim 20, wherein the soldering portion of the circuit board comprises a soldering pad and the soldering portion of the terminal comprises a soldering surface, or the soldering portion of the circuit board comprises a soldering hole and the soldering portion of the terminal is configured to protrude into the soldering hole.

* * * * *